US005236269A

United States Patent [19]

Handy

[11] Patent Number: 5,236,269

[45] Date of Patent: Aug. 17, 1993

[54] BATTERY-POWERED DISPENSER FOR HOT MELT ADHESIVE

[75] Inventor: John N. Handy, Long Beach, Calif.

[73] Assignee: Mattel, Inc., El Segundo, Calif.

[21] Appl. No.: 4,369

[22] Filed: Jan. 14, 1993

[51] Int. Cl.[5] ..... B67D 5/62

[52] U.S. Cl. ..... 401/1; 219/227; 219/230; 219/240; 222/146.5

[58] Field of Search ..... 219/227, 230, 240; 401/1, 2; 222/146.5

[56] References Cited

U.S. PATENT DOCUMENTS

| | | | |
|---|---|---|---|
| 2,556,609 | 6/1951 | Arkless . | |
| 2,681,685 | 6/1954 | Arkless . | |
| 3,204,826 | 9/1965 | Paulsen . | |
| 3,281,576 | 10/1966 | Cooper et al. . | |
| 3,298,572 | 1/1967 | Newton . | |
| 3,459,335 | 8/1969 | Cohen et al. . | |
| 3,543,968 | 12/1970 | Reighard et al. . | |
| 3,776,426 | 12/1973 | Newton . | |
| 3,868,046 | 2/1975 | Maddalena . | |
| 4,014,464 | 3/1977 | Newton et al. . | |
| 4,463,877 | 8/1984 | Siwon . | |
| 4,744,688 | 5/1988 | Silber . | |
| 4,773,566 | 9/1988 | Hoagland . | |
| 4,795,064 | 1/1989 | Sheu . | |
| 4,815,636 | 3/1989 | Stede et al. . | |
| 4,826,049 | 5/1989 | Speer . | |
| 4,883,942 | 11/1989 | Robak, Sr. et al. | 219/227 |
| 4,916,289 | 4/1990 | Suhanek . | |
| 4,938,388 | 7/1990 | Yeh . | |
| 4,948,944 | 8/1990 | Oster . | |
| 4,949,881 | 8/1990 | Watanabe et al. . | |
| 5,026,187 | 6/1991 | Belanger et al. . | |

FOREIGN PATENT DOCUMENTS

| | | | |
|---|---|---|---|
| 603821 | 10/1946 | United Kingdom | 219/230 |
| 1153100 | 5/1969 | United Kingdom | 219/240 |

*Primary Examiner*—Steven A. Bratlie
*Attorney, Agent, or Firm*—Roy A. Ekstrand

[57] ABSTRACT

A battery-powered dispenser for hot melt adhesive includes an elongated housing supporting a battery power source therein. A heat exchanger is supported within the housing interior and includes an elongated heat exchanger and a resilient support guide sleeve for receiving a to-be-melted low temperature stick. The heat exchanger includes a discharge nozzle and a recess for receiving and supporting an escott heating element which is operatively coupled to the battery power source.

11 Claims, 2 Drawing Sheets

FIG. 1
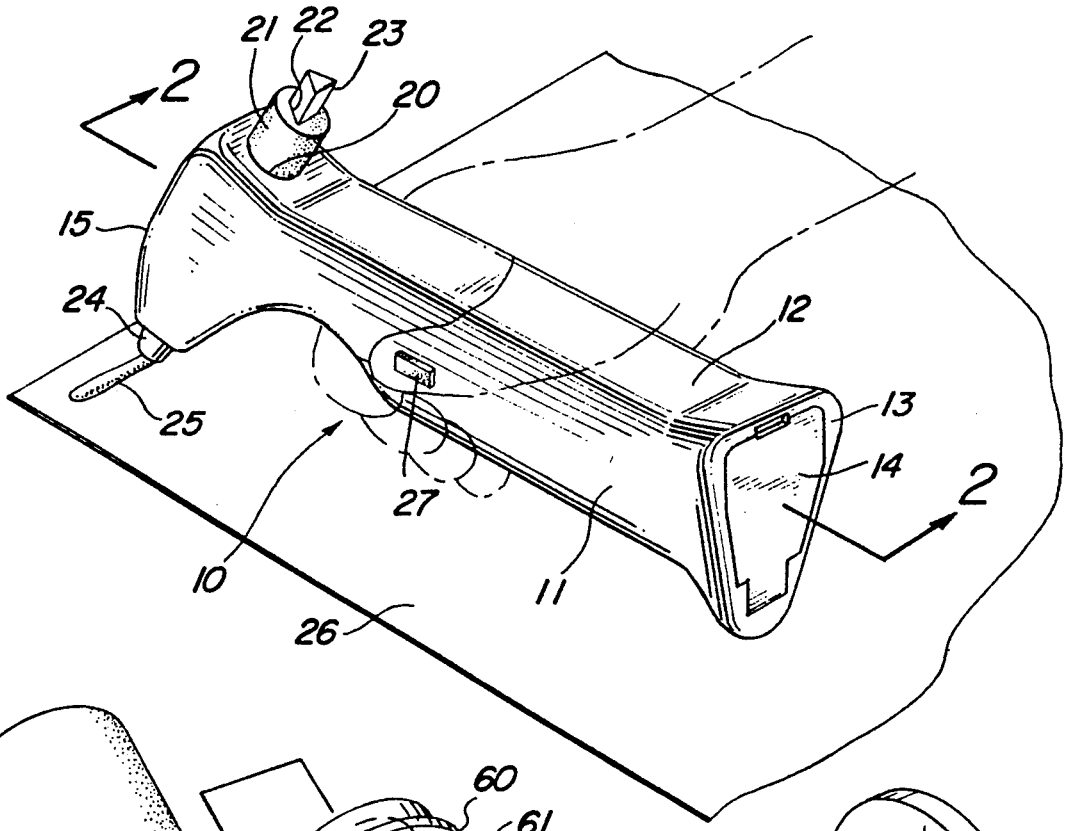
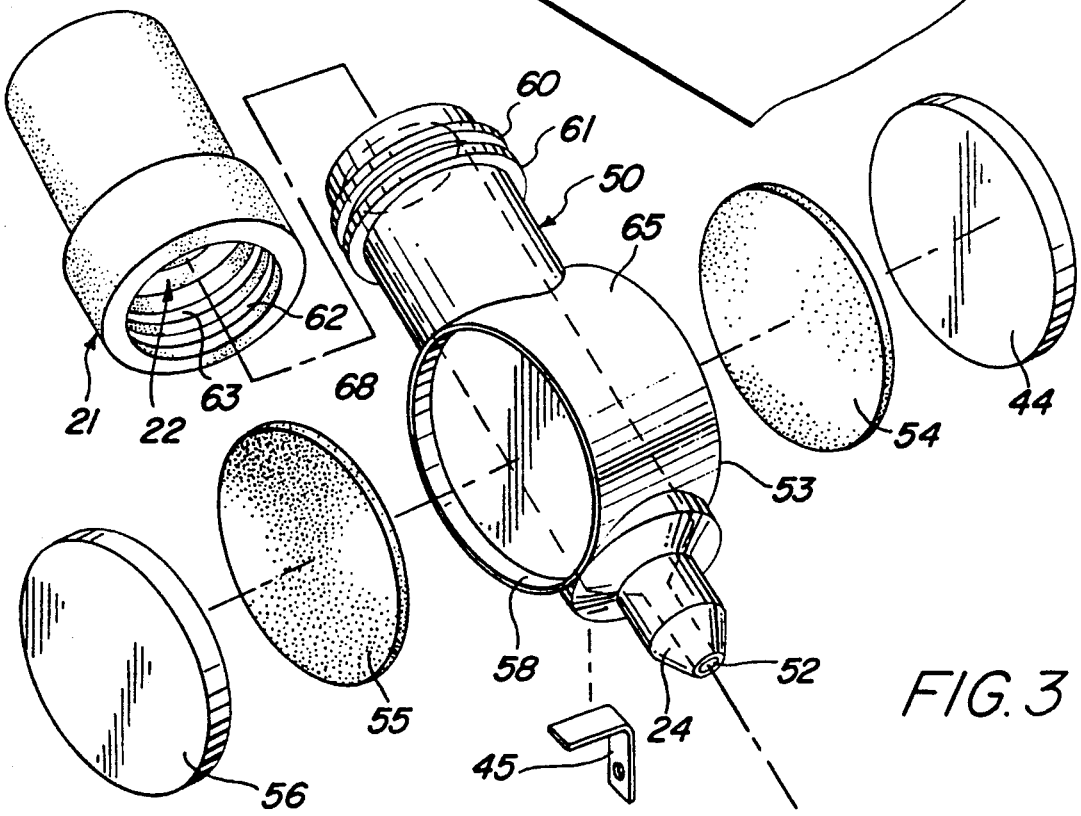
FIG. 3

FIG. 2
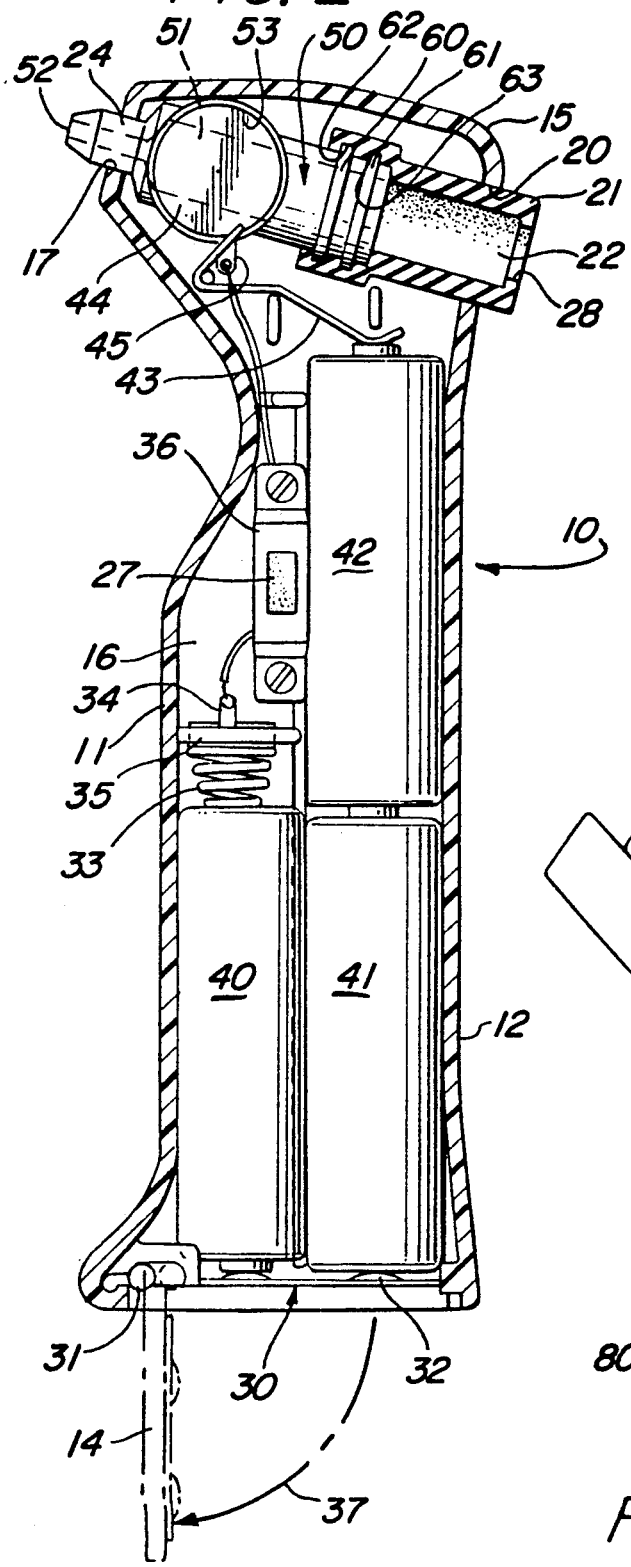
FIG. 4
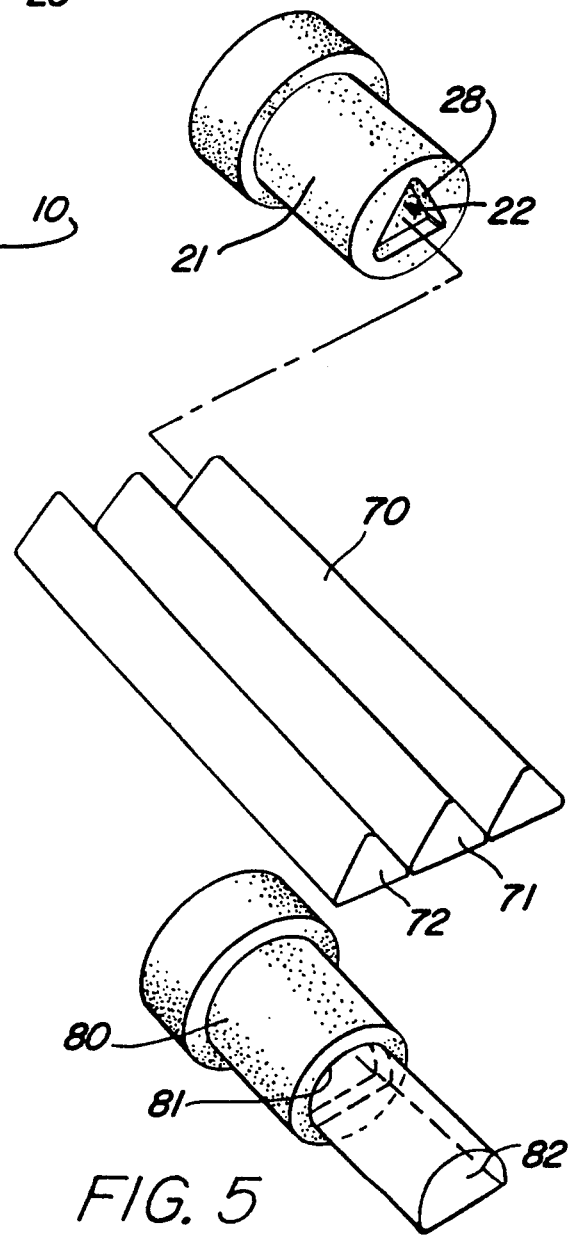
FIG. 5

BATTERY-POWERED DISPENSER FOR HOT MELT ADHESIVE

CROSS-REFERENCE TO RELATED PATENT APPLICATION

This application discloses apparatus described and claimed in a relating application Ser. No. 07/930564, filed Aug. 17, 1992. which is assigned to the Assignee of the present application.

FIELD OF THE INVENTION

This invention relates generally to gluing and adhesive dispensing devices and particularly to those used for hot melt or heat softened adhesive materials.

BACKGROUND OF THE INVENTION

Hot melt adhesive material extruders or dispensers, often referred to as "glue guns" within the industry have provided an improved system for applying heated adhesive materials or the like. While the individual structures used by manufacturers to provide effective hot melt material dispensers have been subject to substantial variation, all generally include a housing supporting a heating chamber. The heating chamber defines an internal melt passage. An electrical power source such as a resistance heating element is thermally operative upon the heating chamber to provide elevated temperature within the melt passage. An elongated rod or bar of meltable adhesive material or the like is introduced into the heating chamber melting passage and partially or completely liquified therein and is discharged outwardly from the heating chamber through a dispensing nozzle.

For example, U.S. Pat. 4,463,877 issued to Siwon sets forth a DEVICE FOR GUIDING A ROD-SHAPED MEMBER FORMED OF A GLUING MATERIAL WHICH CAN BE SOFTENED BY HEAT in which a heater supports a flexible cartridge secured to one end thereof by a metal sleeve. The metal sleeve extends beyond the heater and surrounds a portion of the cartridge for conducting heat to a section of the cartridge removed from the heater. In one embodiment, the metal heat conducting sleeve is formed of a pair of coiled metal wires.

U.S. Pat. No. 5,026,187 issued to Belanger, et al. sets forth a DISPENSER FOR HOT-MELT MATERIAL which includes a heat conductive removable cartridge containing the to-be-melted adhesive together with a chamber for receiving the cartridge and a heater adjacent the cartridge for melting the adhesive prior to dispensing through the nozzle. Pressure is applied through a plunger coupled to the material to expel adhesive through the nozzle.

U.S. Pat. No. 4,949,881 issued to Watanabe, et al. sets forth a PORTABLE GUN-TYPE ADHESIVE DISCHARGER having a material dispensing nozzle and a chambered heating element supported within a pistol grip housing A removable plunger is received within the pistol grip housing and slidably movable to exert pressure against the heated material. A pistol grip level is pivotally coupled to the housing and is squeezed by the user. The interior end of the lever is operatively coupled to the movable plunger to exert a force used to feed the adhesive stick toward the heating chamber.

U.S. Pat. No. 4,948,944 issued to Oster sets forth a COMPACT HEATER ASSEMBLY FOR A HOT MELT APPLICATOR having a pistol grip-shaped housing supporting a heating chamber and dispensing nozzle therein. A movable lever is coupled to a material feeding mechanism which is operative as the handle is squeezed to feed material into the melting chamber.

U.S. Pat. No. 4,938,388 issued to Yeh sets forth a GLUE TRANSPORT MECHANISM FOR A MOLTEN GLUE DISCHARGING DEVICE having a heating element, a transporting tube and a gear to move the introduced glue strips such that the melted glue is delivered through a tube.

U.S. Pat. No. 4,916,289 issued to Suhanek sets forth a PLASTIC WELDER having a pistol grip housing supporting a heating element and a supply rod of meltable material supportable therein. A feeding mechanism operates automatically to provide movement of the melt material into the heating element.

U.S. Pat. No. 4,826,049 issued to Speer sets forth a CORDLESS ADHESIVE DISPENSING SYSTEM having an electrically heated dispensing gun and cooperating base for supporting the gun. Mechanical and electrical connections are provided between the base and the gun.

U.S. Pat. No. 4,815,636 issued to Stede, et al. sets forth a HOT MELT GUN having a melt chamber and a mechanism for feeding a rod of hot melt material into the chamber for melting and dispensing. The feeding mechanism includes a carriage mounted for movement to and from the melt body. A clamp member pivotally mounted on the carriage and a trigger to cause the clamp member to grip the rod and feed it into the chamber as the trigger is moved.

U.S. Pat. No. 4 795 064 issued to Shew sets forth a GAS HEATED GLUE GUN having a heating chamber and a self-contained supply of gas and a burner mechanism for heating the melt material within the heating chamber.

U.S. Pat. No. 4,773,566 issued to Hoagland sets forth a HOT MELT ADHESIVE APPLICATOR configured to dispense relatively large volumes of molten adhesive at relatively fast rates. A barrel and rotary valve block are supported within a housing and control the flow of molten adhesive. Heaters attached to the barrel maintain the adhesive in a molten state.

U.S. Pat. No. 4,744,688 issued to Silber sets forth a HAND TOOL FOR APPLYING HOT MELT ADHESIVE includes a housing supporting an applicator roller which receives liquified adhesive through an adjacent slot in a retention chamber.

U.S. Pat. No. 4,014464 issued to Newton, et al. sets forth a HOT MELT DISPENSER AND METHOD OF MAKING ITS MELT BODY in which the melt body is a generally conical melting chamber extending between an inlet and a relatively smaller outlet passage. One or more bypass members are interconnected to the melting chamber by a plurality of spaced radial bores arranged to conduct hot melt from successive outer layers of the material as it is being progressively softened and liquified in the chamber for flowing to the outlet.

U.S. Pat. No. 3,868,046 issued to Maddalena sets forth an EXTRUDER for dispensing highly viscous sealant compounds. The extruder provides a rotatably mounted extruding screw axially mounted within a barrel and a power head for driving the extruding screw to transport the material to an exit orifice in the barrel.

U.S. Pat. No. 3,776,426 issued to Newton sets forth ADHESIVE EXTRUDERS for melting and dispensing heat softenable thermal plastic material such as adhesives. The extruder includes a main body portion having therein a melting chamber, an inlet passageway leading into one end of the chamber and a discharge passageway in communication with the chamber at the other end thereof. The melt chamber defines a cross section which progressively diminishes from the inlet end toward the discharge end.

U.S. Pat. No. 3,543,968 issued to Reighard sets forth a GUN FOR DISPENSING THERMOPLASTIC MATERIALS having a gun-shaped housing and defining a barrel and trigger control mechanism. The gun further defines conduits within the housing and handle which receive thermoplastic material for transport to the heating chamber within the gun-shaped housing.

U.S. Pat. No. 3,459,335 issued to Cohen, et al. sets forth a MANUAL DISPENSER FOR HEATED ADHESIVE in which an elongated cylindrical member defines an interior heating chamber receiving the adhesive or glue. The heating chamber is rigid or shape sustaining and a gas pressure is applied to one end of the melt chamber to cause the fillable adhesive to be dispensed through an outlet in the other end of the chamber.

U.S. Pat. No. 3,298,572 issued to Newton sets forth CEMENT DISPENSERS having a heating chamber defining a dispensing nozzle at one end and an input passage at the other end. A resilient sleeve is secured to the input end of the heating chamber and resiliently supports a rod of to-be-melted adhesive material. U.S. Pat. No. 2,556,609 and 2,681,685 both issued to Arkless and both entitled PLASTIC WELDING DEVICE set forth similar hot melt apparatus having means for dispensing a heated plastic adhesive material which includes a pistol grip housing having a pivotally supported feed lever secured to the handle portion thereof and operatively coupled to the to-be-melted adhesive.

U.S. Pat. No. 3,204,826 issued to Paulsen sets forth a PORTABLE THERMOPLASTIC CEMENT DISPENSERS having a melting chamber securable to the output end of a convention soldering iron. The melting chamber receives an elongated cylindrical rod of to-be-melted material at one end and dispenses melted material out the nozzle supported at the remaining end. The user's finger pressure is applied to the rod of material to force it into and through the heating chamber.

U.S. Pat. No. 3,281,576 issued to Cooper, et al. sets forth an ELECTRICALLY HEATED THERMOPLASTIC CEMENT EXTRUDER having a pistol grip housing supporting an electrically heated melt chamber and receiving an elongated meltable rod of thermoplastic cement. A thumb wheel feed mechanism is rotated to provide a driving force against the thermoplastic cement.

While the foregoing described prior art devices have provided satisfactory operation in many environments, they do not provide a convenient battery-powered structure usable in a low temperature melt child safe environment. There remains, therefore, a need in the art for a low temperature melt child safe battery-powered dispenser for hot melt material.

SUMMARY OF THE INVENTION

Accordingly, it is a general object of the present invention to provide an improved battery-powered dispenser for hot melt adhesive material. It is a more particular object of the present invention to provide an improved battery-powered dispenser for hot melt adhesive material which may be utilized in combination with low temperature melt adhesive material and which is child safe.

In accordance with the present invention, there is provided for use in combination with a meltable material stick, a dispenser comprises: a housing defining a interior cavity and first and second apertures; a heat exchanger supported within the housing and defining a body, a nozzle end extending outwardly through the first aperture, a recess, a planar surface and a passage through the body; a disk-shaped heating element received at least partially within the recess having a first surface contacting the planar surface and an outer second surface; a connector supported in contact against the second surface, electrical power means within the housing including a battery power source and connection means for coupling the battery power source to the connector and the heat exchanger to energize the heating element; and a resilient guide sleeve having a guide passage therein coupled to the heat exchanger and extending outwardly from the interior cavity through the second aperture in the housing.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several FIGURES of which like reference numerals identify like elements and in which:

FIG. 1 sets forth a perspective view of a battery-powered dispenser for hot melt adhesive constructed in accordance with the present invention in a typical use;

FIG. 2 sets forth a section view of the present invention dispenser for hot melt adhesive taken along section lines 214 2 in FIG. 1;

FIG. 3 sets forth a perspective assembly view of the melting chamber and associated components of the present invention dispenser for hot melt adhesive;

FIG. 4 sets forth a perspective view of several rods of hot melt adhesive together with a portion of the present invention dispenser for hot melt adhesive; and FIG. 5 sets forth a perspective view of an alternate embodiment of the present invention dispenser for hot melt adhesive.

DESCRIPTION OF THE PREFERRED EMBODIMENTS

FIG. 1 sets forth a perspective view of a hot melt adhesive dispenser constructed in accordance with the present invention and generally referenced by numeral 10. Dispenser 10 includes an elongated housing 11 defining a handle portion 12, an end portion 13 and a melt head 15. End portion 13 supports a hingeably secured access door 14. A power button 27 is supported by handle portion 12. Housing 11 further defines an aperture 20 receiving a resilient sleeve guide 21 which in turn defines a guide passage 22. An adhesive material melt stick 23 extends into resilient sleeve guide 21 through guide passage 22. As is better seen in FIG. 2, dispenser 10 includes an internal heat exchanger 50 coupled to sleeve guide 21 and terminating in an outwardly extending discharge nozzle 24. Battery-powered means coupled to power button 27 provide heating of heat exchanger 50 within melt head 15 and the discharge of melted adhesive 25 outwardly through discharge nozzle 24.

Thus, utilizing a material to be adhesively bonded to another element such as material sheet 26, the user grasps hot melt dispenser 10 in the manner shown having inserted an adhesive melt stick 2 through sleeve guide 21 into the internal heat exchanger within melt head 15. Thereafter, the user depresses power button 27 as handle portion 12 is gripped and presses against the exposed end of melt stick 23 forcing melted adhesive outwardly from discharge nozzle 24.

It should be noted that in the preferred embodiment of the present invention adhesive melt stick 23 is fabricated to define at least one faceted portion for convenient storage of the adhesive melt material.

Because hot melt dispenser 10 is fabricated to conserve battery power and to be safe for use by young children, it is utilized in combination with a low temperature melting adhesive material. Thus, hot melt stick 23 is preferably fabricated of a low temperature melting adhesive material of the type set forth in the above-identified related application.

FIG. 2 sets forth a section view of hot melt dispenser 10 taken along section lines 2—2 in FIG. 1. As described above, dispenser 10 includes a housing 11 having a handle portion 12, an end 13 and a melt head 15. End 13 defines an aperture 30 and a door 14. Door 14 is hingeably coupled by a hinge 31 to provide access to the interior of housing 11 through aperture 30. Housing 11 defines an interior cavity 16, an aperture 20 and an aperture 17. A plurality of conventional batteries 40, 41 and 42 are received within interior cavity 16 and supported by conventional support means. A contact support 35 formed within housing 11 supports a contact spring 33 having a tab 34. A power switch 36 includes a depressible power button 27 and is operatively coupled to tab 34 of contact spring 33 by a conventional connecting wire. Door 14 supports a metal battery contact bridge 32 which in the closed position of door 14 provides electrical contact between batteries 40 and 41.

A heat exchanger 50 formed of a heat conducting material such as aluminum defines an interior melt passage 51 and an outwardly extending nozzle 24. Nozzle 24 defines a nozzle passage 52 in communication with melt passage 51 and extends outwardly through aperture 17 in housing 11. Heat exchanger 50 is supported within melt head 15 by conventional fabrication means (not shown). Heat exchanger 50 further defines a recess 53 which receives a heating element 54 (better seen in FIG. 3) and a disk-shaped connector 44. Connector 44 includes a connecting tab 45 which is coupled to switch 36 by a conventional connecting wire. A spring contact 43 is supported within interior cavity 16 by conventional attachment means and provides electrical connection between connector 44 and battery 42.

Heat exchanger 50 supports a generally cylindrical resilient guide sleeve 21 coupled to the input end of heat exchanger 50 and extending outwardly through aperture 20 of housing 11. Guide sleeve 21 defines a guide passage 22 and an inwardly extending lip 28. As is better seen in FIG. 4, lip 28 defines a faceted cross-section corresponding to the cross-sectional configuration of melt stick 23. Heat exchanger 50 defines a pair of outwardly extending annular ribs 60 and 61. Correspondingly, guide sleeve 21 defines a pair of inwardly extending grooves 62 and 63. Thus, guide sleeve 21 is received upon heat exchanger 50 by resilient stretching of guide sleeve 21 and positioned such that ribs 60 and 61 extend into and interlock with grooves 62 and 63 respectively. The cooperation of ribs 60 and 61 with grooves 62 and 63 secures guide sleeve 21 in the position shown.

As will be apparent from FIG. 2, one of the primary functions of door 14 is to provide access to batteries 40, 41 and 42 within interior cavity 16 of housing 11. Thus, the batteries within housing 11 may be readily removed and replaced and captivated within housing 11 by the closure of door 14.

FIG. 3 sets forth a perspective assembly view of heat exchanger 50 together with connector 44 and escott heating device 54 as well as guide sleeve 21. As described above, heat exchanger 50 is preferably formed of a heat conductive material such as aluminum or zinc and defines an elongated cylindrical member having a pair of ribs 60 and 61 at the input end and a tapered nozzle 24 extending outwardly from the delivery end of the heat exchanger. Heat exchanger 50 also defines a generally cylindrical barrel portion 65 which in turn defines a pair of cylindrical recesses 53 and 58 on opposite sides thereof. Recesses 53 and 58 terminate in generally planar interior surfaces 64 and 68 respectively. Recess 53 and surface 64 are not visible in FIG. 3 due to the perspective of the assembly FIGURE therein. However, it should be understood by those skilled in the art that heat exchanger 50 is symmetrical and thus recess 53 and planar surface 64 are identical to recess 58 and surface 68. Heat exchanger 50 further defines an internal melt passage 51 extending through heat exchanger 50 and terminating in a reduced diameter nozzle passage 52. Nozzle passage 52 extends through nozzle 24 and communicates with melt passage 51. A resilient guide sleeve 21 defines a generally cylindrical member formed of a resilient material and defining a pair of internal grooves 62 and 63. As is shown above in FIG. 2, resilient guide sleeve 21 is fitted upon the input end of heat exchanger 50 and maintained in attachment thereto by the extension of the ribs 60 and 61 into grooves 62 and 63 respectively.

As escott heating element 54 defines a generally disk-shaped element which in received within recess 53 against planar surface 64. To aid the thermocoupling between heating element 54 and heat exchanger 50, a silicone heat transfer gel is preferably applied to the mating surface of heating element 54 and heat exchanger 50. A connector 44 forms a flat or gently curved metal member which is supported against heating element 54 by the interior structure of housing 11 (not shown) in accordance with conventional molded plastic fabrication techniques. In addition, a metal connecting tab 45 is positioned in contact with heat exchanger 50 at a convenient position to provide electrical connection between heat exchanger 50 and power switch 36 (seen in FIG. 2). Thus, escott heating element 54 is electrically connected between connector 44 which is coupled to battery 42 as is shown in FIG. 2 and power switch 36 via heat exchanger 50 and tab 45.

In the configuration shown in FIG. 3, a second heating element 55 and connector 56 are shown positioned in alignment for assembly within recess 58 of heat exchanger 50. It is anticipated that in most operative situations a second heating element will not be necessary and thus heating element 55 and connector 56 may in most situations be omitted. However, in the event additional heating energy for heat exchanger 50 is desired, FIG. 3 sets forth the assembly of a second heating element 55 and connector 56 within recess 58 to provide such additional heating power.

FIG. 4 sets forth a perspective assembly view of resilient guide sleeve 21 together with a plurality of adhesive melt sticks. As described above, guide sleeve 21 defines an interior guide passage 22 and an inwardly extending lip 28. In its preferred form, lip 28 defines a cross-section corresponding to the melt stick adhesive to be received therein. Thus, in connection with the use of adhesive melt sticks such as melt stick 23 which defines a triangular cross-section, lip 28 extends inwardly to form a triangular aperture in communication with guide passage 22. A plurality of melt sticks such as melt sticks 70, 71 and 72 are insertable into guide passage 22 of guide sleeve 21 and are fitted within lip 28. Because of low melting temperature material is used to fabricate the melt sticks of the present invention hot melt dispenser, the adhesive material melt sticks used are preferably formed to define at least one faceted surface which serves to receive the melt sticks in a convenient arrangement for storage and transportation. Thus, for example, melt sticks 70, 71 and 72 being formed of a triangular cross-section are conventiently arranged in a linear array for convenient storage. This accommodates the low melting temperature of the melt stick material during storage and precludes undesired melting together of the melt sticks when subjected to high ambient temperatures.

FIG. 5 sets forth an alternate embodiment of the present invention in which the guide sleeve 80 defines a semi-circular aperture 81. Correspondingly, a melt stick 82 is formed in a semi-cylindrical configuration to be received within guide sleeve 80 and pass through aperture 81. Guide sleeve 80 is, for all other purposes, configured in the same manner as set forth above for guide sleeve 21 and thus is receivable upon and secured to heat exchanger 50 in the manner described above for guide sleeve 21. It will be apparent to those skilled in the art that other faceted shapes may be used for guide sleeves and adhesive melt stick material while still benefiting from the convenient storage aspects described herein. It will be equally apparent to those skilled in the art that a cylindrical melt stick and guide sleeve having a circular opening therein may, of course, still be used in the present invention structure should it be unnecessary to include a faceted shape to the melt stick.

What has been shown is a low temperature batter-powered dispenser for hot melt adhesive which makes maximum use of battery power and utilizes an escott heating element to provide a low temperature adhesive melt capability which is safe for use by young children. The dispenser provided utilizes an extremely simple, efficient configuration which makes optimum use of the heat provided by an escott heating element and which substantially reduces the fabrication costs of the dispenser itself.

It will be apparent to those skilled in the art that while the operation of the battery-powered dispenser for hot melt adhesive set forth herein has been illustrated using an adhesive material, the dispenser may alternatively be used for the melting and depositing of virtually any low temperature melt material without departing from the spirity and scope of the present invention. For example, low temperature melting sticks may be utilized to provide convenient melting in the battery-powered dispenser of the present invention to deposit molten plastic material into a convenient mold or the like and thus form a molded element.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a meltable material stick, a dispenser comprising:

a housing defining an interior cavity and first and second apertures;

a heat exchanger supported within said housing and defining a body, a nozzle end extending outwardly through said first aperture, a recess, a planar surface and a passage through said body;

a disk-shaped heating element received at least partially within said recess having a first surface contacting said planar surface and an outer second surface;

a connector supported in contact against said second surface, electrical power means within said housing including a battery power source and connection means for coupling said battery power source to said connector and said heat exchanger to energize said heating element; and a resilient guide sleeve having a guide passage therein coupled to said heat exchanger and extending outwardly from said interior cavity through said second aperture in said housing.

2. A dispenser as set forth in claim 1 wherein said heat exchanger defines an extending rib and wherein said resilient guide sleeve defines a groove for receiving said rib and securing said guide sleeve to said heat exchanger.

3. A dispenser as set forth in claim 2 wherein said resilient guide sleeve further defines an outer end having an inwardly extending resilient lip for gripping said meltable material stick.

4. A dispenser as set forth in claim 3 wherein said meltable material stick defines a faceted outer surface and wherein said inwardly extending lip of said sleeve defines a correspondingly faceted opening.

5. A dispenser as set forth in claim 1 wherein said heating element comprises an escott device.

6. A dispenser as set forth in claim 4 wherein said heating element comprises an escott device.

7. For use in combination with a meltable material stick, a dispenser comprising:

a housing defining an interior cavity and first and second apertures;

a heat exchanger supported within said housing and defining a body, a nozzle end extending outwardly through said first aperture, first and second recesses, first and second planar surfaces and a passage through said body;

first and second disk-shaped heating element received at least partially within said first and second recesses each having a first surface contacting said plannar surfaces and an outer second surface;

first and second connectors supported in contact against said second surfaces of said first and second heating elements, electrical power means within said housing including a battery power source and connection means for coupling said battery power source to said first and second connectors and said heat exchanger to energize said heating element; and a resilient guide sleeve having a guide passage therein coupled to said heat exchanger and extending outwardly from said interior cavity through said second aperture in said housing.

8. A dispenser as set forth in claim 7 wherein said heat exchanger defines an extending rib and wherein said resilient guide sleeve defines a groove for receiving said rib and securing said guide sleeve to said heat exchanger.

9. A dispenser as set forth in claim 8 wherein said resilient guide sleeve further defines an outer end having an inwardly extending resilient lip for gripping said meltable material stick.

10. A dispenser as set forth in claim 9 wherein said meltable material stick defines a faceted outer surface and wherein said inwardly extending lip of said sleeve defines a correspondingly faceted opening.

11. A dispenser as set forth in claim 7 wherein said heating element comprises an escott device.

* * * * *